US007781731B2

(12) United States Patent
Kim et al.

(10) Patent No.: US 7,781,731 B2
(45) Date of Patent: Aug. 24, 2010

(54) METHOD AND APPARATUS FOR QUALITATIVELY ANALYZING HIGH-MOLECULAR ADDITIVES IN METAL PLATING SOLUTION

(75) Inventors: Yun Hee Kim, Gyunggi-do (KR); Bae Kyun Kim, Gyunggi-do (KR); Dong Hyun Cho, Gyeongsangnam-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 288 days.

(21) Appl. No.: 12/216,250

(22) Filed: Jul. 1, 2008

(65) Prior Publication Data

US 2009/0278041 A1 Nov. 12, 2009

(30) Foreign Application Priority Data

May 6, 2008 (KR) ..... 10-2008-0041950

(51) Int. Cl.
*H01J 49/00* (2006.01)

(52) U.S. Cl. ..... 250/287; 250/288; 250/339.07; 436/56; 436/164; 356/301; 205/263; 205/238; 205/296; 205/291; 205/99; 205/261

(58) Field of Classification Search ..... 250/289, 250/288, 339.07; 436/56, 164; 356/301; 205/263, 238, 296, 291, 99, 261
See application file for complete search history.

(56) References Cited

U.S. PATENT DOCUMENTS

2003/0049850 A1* 3/2003 Golden ..... 436/56

* cited by examiner

*Primary Examiner*—Jack I Berman
*Assistant Examiner*—Meenakshi S Sahu

(57) ABSTRACT

Disclosed herein is a method of qualitatively analyzing high-molecular additives in a metal plating solution, including: removing sulfate ions and metal ions from a metal plating solution; and qualitatively analyzing the metal plating solution, from which sulfate ions and metal ions are removed, using Matrix-Assisted Laser Desorption/Ionization Time-Of-Flight Mass Spectroscopy (MALDI-TOF MS). The method is advantageous in that the structure and molecular weight of high-molecular additives present in very small amounts in a plating solution can be accurately measured while maintaining the specific structure and molecular weight thereof without degrading the high-molecular additives.

15 Claims, 7 Drawing Sheets

METHOD AND APPARATUS FOR QUALITATIVELY ANALYZING HIGH-MOLECULAR ADDITIVES IN METAL PLATING SOLUTION

CROSS REFERENCE TO RELATED APPLICATION

This application claims the benefit of Korean Patent Application No. 10-2008-0041950, filed May 6, 2008, entitled "Qualitative analysis method and apparatus for high-molecular additives in metal plating solutions", which is hereby incorporated by reference in its entirety into this application.

BACKGROUND OF THE INVENTION

1. Field of the Invention

The present invention relates to a method and apparatus for qualitatively analyzing high-molecular additives in a metal plating solution, and, more particularly, to a method and apparatus for qualitatively analyzing high-molecular additives in a metal plating solution, by which the state of a sample to be qualitatively analyzed is optimized by removing excess sulfate ions and metal ions from a metal plating solution without degrading high-molecular additives, and then the specific structure and molecular weight of a very small amount of high-molecular additives can be measured.

2. Description of the Related Art

A metal plating solution may include sulfuric acid ($H_2SO_4$), copper sulfate ($CuSO_4$) and hydrochloric acid (HCl), each of which is a basic chemical commonly used in the metal plating solution, and three kinds of additives, each of which is a chemical controlling the characteristics of plating. The three kinds of additives are as follows.

First, there is a brightener, serving to physically increase plating density by adsorbing the brightener on a plating surface and thus making plating particles dense. Typically, the brightener, which is a water-soluble sulfonic acid containing a mercapto group and a thio group, exists in a plating solution in an anionic state.

Second, there is a leveler (strong plating suppressor) serving to smooth and flatten the entire plating surface by bonding to the high current density portion of a reduction electrode surface. The leveler exists in an acidic plating solution as an organic compound containing a cationized nitrogen atom.

Third, there is a carrier (mild plating suppressor) serving to provide improved plating thickness distribution by preventing metal ions from being concentrated on only the high current density portion of a reduction electrode surface (by preventing the polarization of the concentration of metal ions), thus applying uniform plating current, thereby controlling the overall plating rate. The carrier is necessarily required in order to form plating particles having a minutely oriented structure by forming a stable diffusion layer on the surface of a reduction electrode at the time of electroplating, thus controlling the concentration of brightener, carrier and chloride ions. Typically, as the carrier, a high molecular weight material, such as polyethylene glycol (PEG), polypropylene glycol (PPG), or the like, is used.

Since these high-molecular additives, which are used for plating, play a very important role in the characteristics of plating, it is necessary to control them. However, currently, component analysis (qualitative analysis) thereof is not conducted, and only the concentration thereof is controlled. Further, methods of measuring absolute concentrations of a very small amount of organic high-molecular additives present in strong acid are not known.

A method of analyzing the concentrations of organic high-molecular additives in an electrolytic copper sulfate plating solution, which is generally conducted in this field, is a cyclic voltammetric stripping (CVS) method, which is an electrochemical measurement method. In this method, the concentrations of the additives are not individually analyzed, and the concentrations thereof are merely indirectly controlled by changing the voltages of all the additives, thus decreasing accuracy and repeatability. That is, it is not absolutely useful to control the concentrations of the additives through the change in voltages of all the additives.

In particular, among the above high-molecular additives, the carrier has electroplating activity when it can play the above role at the time of electroplating. In this case, when the molecular weight of the carrier is increased, the electroplating activity of the carrier is increased, and when the molecular weight thereof is decreased, the electroplating activity thereof is decreased. In particular, a high-molecular additive used as the carrier must have a molecular weight of 4000 Da or more in order to have electroplating activity. When the molecular weight of the high-molecular additive is decreased to 1000 Da or less, the high-molecular additive lose electroplating activity, so that it cannot serves as a carrier, with the result that plating becomes poor. That is, in order to improve throwing power at the time of plating, the plating rate must be controlled by increasing the electroplating activity of the high-molecular additive for a carrier, and, in order to control the plating rate, a high-molecular additive for a carrier having a molecular weight of 4000 Da or more must be selected, and the selected high-molecular additive must be maintained to have a molecular weight of 4000 Da or more even when plating.

As described above, the physical properties of high-molecular materials are determined by the molecular weight, repetitive units and end group structure thereof, rather than by the concentration thereof. That is, the electroplating activity of the high-molecular material can be evaluated by measuring the molecular weight thereof, and the reactivity of the high-molecular material can be evaluated by analyzing the chemical structure thereof. In conclusion, in the case of the high-molecular additives used in plating, the analysis of the molecular weight and chemical structure thereof is necessarily required.

In particular, in the case of a high-molecular additive for a carrier, since the high-molecular additive is degraded in fragments on the surface of an electrode and thus a stable diffusion layer cannot be formed, the analysis of the molecular weight thereof must be conducted in order to evaluate the electroplating activity thereof at the time of plating. Further, since the repetitive unit and end group of a high-molecular material influence the reactivity thereof, the repetitive unit and end group thereof must also be accurately analyzed.

However, the analysis of the molecular weight and structure of high-molecular additives present in a metal plating solution in very small quantities is not conducted at present.

SUMMARY OF THE INVENTION

Therefore, in order to solve the above problems, the present inventors have researched major factors preventing the mass analysis of high-molecular additives in a plating solution. As a result, it has been found that excess sulfate ions and metal ions included in a plating solution act as major factors preventing high-molecular additives included in the plating solution in very small quantities and matrix from being homogeneously crystallized. Based on the finding, the present inventors have conducted various experiments.

After many trials and errors, the present inventors found that additives included in a metal plating solution can be qualitatively analyzed using Matrix-Assisted Laser Desorption/Ionization Time-Of-Flight Mass Spectroscopy (Hereinafter, referred to as "MALDI-TOF MS") by removing excess sulfate ions and metal ions from the metal plating solution. Based on this finding, the present invention was completed.

Accordingly, the present invention has been made keeping in mind the above problems occurring in the prior art, and an aspect of the present invention is to provide a qualitative analysis method and apparatus for accurately measuring the structure and molecular weight of a very small amount of high-molecular additives which cannot be qualitatively analyzed due to the unknown obstruction occurring in the special environment of conventional metal plating solutions.

Another aspect of the present invention is to provide a qualitative analysis method and apparatus for accurately measuring the structure and molecular weight of a very small amount of high-molecular additives included in a plating solution while maintaining the specific structure and molecular weight thereof without degrading the high-molecular additives.

A method of qualitatively analyzing high-molecular additives in a metal plating solution according to an embodiment of the present invention includes: removing sulfate ions and metal ions from a metal plating solution; and qualitatively analyzing the metal plating solution, from which sulfate ions and metal ions are removed, using Matrix-Assisted Laser Desorption/Ionization Time-Of-Flight Mass Spectroscopy (MALDI-TOF MS).

In the method, the removal of the sulfate ions and metal ions may be conducted using a chemical precipitation method.

Preferably, the chemical precipitation method may be conducted using a precipitant selected from the group consisting of alkali metals or alkali metal hydroxides, nitrates, halogenides, and mixtures thereof. More preferably, the precipitant may be selected from the group consisting of NaOH, KOH, $BaCl_2$, $Ba(NO_3)_2$, $Ba(OH)_2$, and mixtures thereof.

It is preferred that the volume ratio of the precipitant to the metal plating solution be 0.5:1~2.5:1.

Preferably, the qualitative analysis of the metal plating solution using MALDI-TOF MS includes: mixing the metal plating solution, from which sulfate ions and metal ions are removed, with a matrix and a cationization agent to form a crystal; and lasing the crystal and then analyzing the lased crystal using Time-Of-Flight Mass Spectroscopy (TOF-MS).

Preferably, the matrix may be selected from the group consisting of dihydroxybenzoic acid (DHB), sinapinic acid, trihydroxy acetophenone (THAP), hydroxyphenylazo benzoic acid (HABA), dithranol, cyano-hydroxycinnamic acid (CHCA), all-trans-retinoic acid (RA), indoleacrylic acid (IAA), and mixtures thereof.

Preferably, the cationization agent may be selected from the group consisting of alkali metal acetates, transition metal acetates, and mixtures thereof.

More preferably, the matrix may be trihydroxy acetophenone, and the cationization agent may be sodium trifluoroacetate.

It is preferred that the volume ratio of the metal plating solution, matrix and cationization agent be 50:100:1~150:200:1.

In the qualitative analysis of the metal plating solution using MALDI-TOF MS according to a first aspect of the present invention, the forming of the crystal may be conducted by drying the metal plating solution, matrix and cationization agent on a target plate using a dried droplet method. In the qualitative analysis of the metal plating solution using MALDI-TOF MS according to a second aspect of the present invention, the forming of the crystal may be conducted by drying the metal plating solution, matrix and cationization agent on a target plate using a double layer method. In the qualitative analysis of the metal plating solution using MALDI-TOF MS according to a third aspect of the present invention, the forming of the crystal may be conducted by drying the metal plating solution, matrix and cationization agent on a target plate using a sandwich method.

An apparatus for qualitatively analyzing high-molecular additives in a metal plating solution according to another embodiment of the present invention includes: means for removing sulfate ions and metal ions from a metal plating solution; and means for qualitatively analyzing the metal plating solution, from which sulfate ions and metal ions are removed, using Matrix-Assisted Laser Desorption/Ionization Time-Of-Flight Mass Spectroscopy (MALDI-TOF MS).

According to the present invention, in order to analyze the structure and molecular weight of a very small amount of high-molecular additives included in a metal plating solution, which cannot be accurately qualitatively analyzed using conventional technologies, excess sulfate ions and metal ions removed from the metal plating solution and the pretreatment conditions of a sample are optimized, thus enabling qualitative analysis of the high-molecular additives. Further, unlike conventional electrical extraction methods, high-molecular additives in a plating solution are not degraded, and the specific molecular weight thereof is maintained, thus enabling accurate mass analysis. Comparing the peak values in the spectrum obtained using this method with theoretical values, since only a maximum error of about 0.4 Da is shown in the spectrum, it can be seen that this method is very accurate. Further, since the characteristics of the high-molecular additives used in plating are determined by the molecular weight and chemical structure thereof, the degradation and structural change thereof can be monitored at the time of plating, and thus the quality of products can be improved such that the products have excellent plating properties without defects such as voids. Furthermore, the present invention can play an important role in the examination of unknown high-molecular additives and the development of a plating solution at the time of benchmarking the advanced companies.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, preferred embodiments of the present invention will be described in detail with reference to the attached drawings.

As described above, conventionally, in a particular environment, specifically, an acidic metal plating solution, the mass spectra of high-molecular additives included in the acidic metal plating solution in very small amounts cannot be obtained, and thus attempts to analyze the structure and molecular weight of the high-molecular additives in the acidic metal plating solution have not been made. Therefore, the present invention is characterized in that excess sulfate ions and metal ions, acting as major factor preventing the mass analysis of high-molecular additives, are removed while the specific molecular weight of high-molecular additives included in an acidic metal plating solution is maintained in very small quantities without degrading the high-molecular additives, thus accurately analyzing the structure and molecular weight of the high-molecular additives in the metal plating solution.

Figure 1:
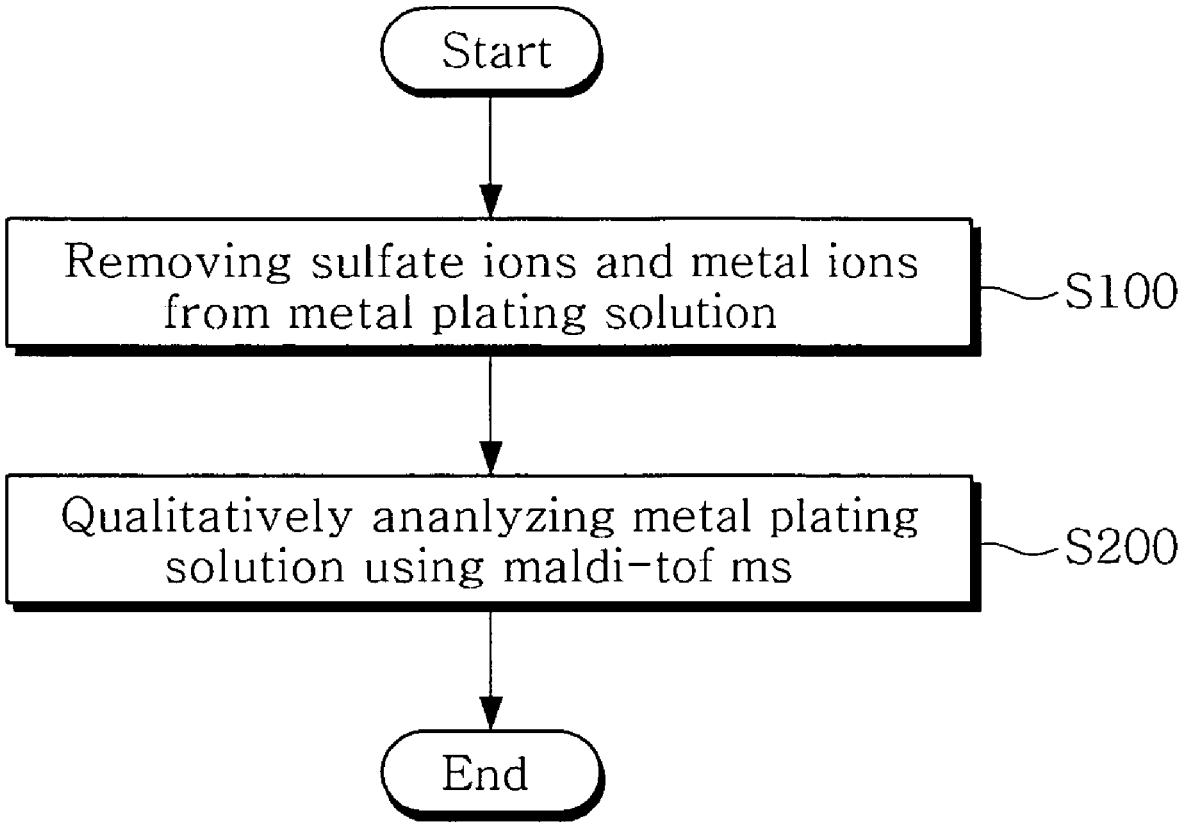
FIG. 1 is a flowchart showing a method of qualitatively analyzing high-molecular additives in a metal plating solution according to an embodiment of the present invention.

FIG. 1 is a flowchart showing a method of qualitatively analyzing high-molecular additives in a metal plating solution according to an embodiment of the present invention.

Referring to FIG. 1, a method of qualitatively analyzing high-molecular additives in a metal plating solution according to an embodiment of the present invention includes: removing sulfate ions and metal ions from a metal plating solution (S100); and qualitatively analyzing the metal plating solution, from which the sulfate ions and metal ions are removed, using Matrix-Assisted Laser Desorption/Ionization Time-Of-Flight Mass Spectroscopy (MALDI-TOF MS) (S200).

The metal plating solution is not particularly limited, as long as it is commonly known in the art, and an example of the metal plating solution may include an electrolytic copper sulfate plating solution having a pH of 1 or less, which is used to fill holes at the time of forming a printed circuit board.

The metal plating solution includes basic chemicals, such as sulfuric acid ($H_2SO_4$), copper sulfate ($CuSO_4$) and hydrochloric acid (HCl), and high-molecular additives, such as a brightener, a leveler and a carrier.

Typically, examples of the brightener may include water-soluble sulfonic acid having a mercapto group or a thio group, such as mercapto compounds, disulfide compounds, dithiocarbamyl compounds, dithiocarbonate ester compounds, isothiuronium compounds, and the like. These compounds exist in a plating solution in an anion state.

Typically, examples of the leveler may include amide compounds, thiourea and derivatives thereof, benzoimidazole compounds, benzothiazole compounds, dimethyl aniline, polyethylene imine, dyes, and the like. These compounds exist as an organic monomolecule containing a cationized nitrogen atom in an acidic metal plating solution.

Typically, examples of the carrier may include organic compounds having a high molecular weight, such as polyethylene glycol (PEG), polypropylene glycol (PPG), polyvinyl alcohol, polyvinyl pyrrolidone, ethoxylated naphthol, and the like.

According to the present invention, in order to enable the mass analysis of high-molecular additives included in a plating solution in very small amounts, primarily, a sample for mass analysis is pretreated by removing excess sulfate ions ($SO_4^{2-}$) and metal ions from the plating solution without degrading the high-molecular additives.

The term "high-molecular additive", used in the present invention, may be generally defined as a high-molecular material having a molecular weight of 1000 or more, and will be understood by those skilled in the art according to high-molecular additives and analysis objects that are actually used.

The removal of the sulfate ions and metal ions (interfering materials) can be conducted without limitation as long as it is commonly know in the art, but it is preferred that the removal of the sulfate ions and metal ions be conducted using a chemical precipitation method, because the sulfate ions and metal ions can be economically and efficiently removed without degrading the high-molecular additives when the chemical precipitation method is used.

For example, the removal of the interfering materials using the chemical precipitation method is conducted by adding a precipitant to the metal plating solution to form a precipitate, filtering the metal plating solution using a centrifugal separator and then separating supernatant liquid from the filter metal plating solution, but the present invention is not limited thereto.

The precipitant, used in the chemical precipitation method, may be suitably selected depending on the kind of acidic metal plating solution that is actually used, and, preferably, may be selected from among alkali metals or alkali metal hydroxides, nitrates, halogenides, and mixtures thereof. More preferably, the precipitant may be selected from among NaOH, KOH, $BaCl_2$, $Ba(NO_3)_2$, $Ba(OH)_2$, and mixtures thereof.

Here, it is preferred from the aspect of efficiency that the volume ratio of the precipitant to the metal plating solution be 0.5:1~2.5:1.

Subsequently, MALDI-TOF Mass Spectroscopy is used in order to analyze the absolute molecular weight and chemical structure of high-molecular additives present in very small amounts in the solution obtained through the pretreatment for removing the interfering materials.

According to the MALDI-TOF Mass Spectroscopy used in the present invention, in order to directly desorb high molecular materials which can be easily degraded even by a small amount of energy, the pretreated metal plating solution is mixed with a matrix and a cationization agent to obtain a crystal, and then the obtained crystal is irradiated using an $N_2$ laser having a strong pulse of 337 nm and is then accurately analyzed using Time-Of-Flight Mass Spectroscopy (TOF-MS).

The matrix may be suitably selected depending on the metal plating solution, including high-molecular additives which are to be actually analyzed. For example, an organic or inorganic matrix having a relatively low molecular weight of 200~300 Da may be used as the matrix, but the present invention is not particularly limited thereto. Preferably, the matrix may be selected from among dihydroxybenzoic acid (DHB), sinapinic acid, trihydroxy acetophenone (THAP), hydroxyphenylazo benzoic acid (HABA), dithranol, cyano-hydroxycinnamic acid (CHCA), all-trans-retinoic acid (RA), indoleacrylic acid (IAA), and mixtures thereof.

The cationization agent is not particularly limited, and may be suitably selected depending on the metal plating solution, including high-molecular additives which are to be actually analyzed and the selected matrix. Preferably, the cationization agent may be selected from among alkali metal acetates, transition metal acetates, and mixtures thereof.

More preferably, trihydroxy acetophenone may be used as the matrix, and sodium trifluoroacetate may be used as the cationization agent.

For more efficient analysis, it is preferred that the volume ratio of the metal plating solution, matrix and cationization agent be 50:100:1~150:200:1.

Meanwhile, in order to enable more homogeneous crystallization, the crystal may be formed by drying the metal plating solution, matrix and cationization agent on a target plate using a dried droplet method, a double layer method or a sandwich method.

For example, the dried droplet method may be conducted by spotting a mixed sample solution, in which the pretreated plating solution is mixed with a matrix and a cationization agent, on a target plate, thus drying the mixed sample solution. For example, the double layer method may be conducted by primarily spotting a matrix solution on a target plate and thus drying the matrix solution, and then secondarily spotting a mixed solution, in which the pretreated plating solution is mixed with a matrix and a cationization agent, on the dried matrix solution and thus drying the mixed solution. For example, the sandwich method may be conducted by primarily spotting a matrix solution on a target plate and thus drying the matrix solution, and then secondarily spotting a mixed solution, in which the pretreated plating solution is mixed with a matrix and a cationization agent, on the dried matrix solution and thus drying the mixed solution, and then tertiarily spotting a matrix solution on the dried mixed solution and thus drying the matrix solution.

Further, the present invention provides an apparatus for qualitatively analyzing high-molecular additives in a metal plating solution, including: means for removing sulfate ions and metal ions from a metal plating solution; and means for qualitatively analyzing the metal plating solution, from which sulfate ions and metal ions are removed, using Matrix-Assisted Laser Desorption/Ionization Time-Of-Flight Mass Spectroscopy (MALDI-TOF MS).

As described above, according to the present invention, in order to conduct the qualitative analysis of high-molecular additives, particularly, MALDI-TOF Mass Spectroscopy, a sample is pretreated to remove materials interfering with mass analysis therefrom to thus optimize it, so that a homogeneous crystal is formed when a very small amount of high-molecular additives is mixed with a matrix, with the result that the high-molecular additives can be easily desorbed and ionized, thereby efficiently analyzing the structure and molecular weight of the high-molecular additives.

Hereinafter, the present invention will be described in more detail with reference to the following Examples and Comparative Examples, but the scope of the present invention is not limited thereto.

PREPARATION EXAMPLE 1

Preparation of Electrolytic Copper Sulfate Plating Solution Sample 140 g of sulfuric acid ($H_2SO_4$, 60%), 30 g of copper sulfate ($CuSO_4$) and 30 ppm of hydrochloric acid (HCl, 35%) were dissolved in deionized water to form a basic plating solution, and then 25 mg of polyethylene glycol (PEG), having a molecular weight of 4000 Da, was added to the basic plating solution to prepare an electrolytic copper sulfate plating solution.

PREPARATION EXAMPLE 2

Preparation of Pretreated Plating Solution, from which Copper Ions and Sulfate Ions are Removed, using Sodium Hydroxide (NaOH)

10 mL of the electrolytic copper sulfate plating solution sample prepared in Preparation Example 1 was put into a 100 mL beaker and was then stirred. 17.5 mL of a 1 M sodium hydroxide (NaOH) solution was slowly dropped onto the stirred plating solution to form a precipitate. When the precipitate was formed, the dropping of the sodium hydroxide solution was stopped, the plating solution was centrifuged, and then the precipitate was removed from the centrifuged plating solution and only the supernatant liquid was separated therefrom and then prepared.

PREPARATION EXAMPLE 3

Preparation of Pretreated Plating Solution, from which Copper Ions and Sulfate Ions are Removed, using Barium Chloride ($BaCl_2$)

10 mL of the electrolytic copper sulfate plating solution sample prepared in Preparation Example 1 was put into a 100 mL beaker and was then stirred. 40 mL of a 0.1 M barium chloride ($BaCl_2$) solution was slowly dropped onto the stirred plating solution to form a precipitate. When the precipitate was formed, the dropping of the barium chloride solution was stopped, the plating solution was centrifuged, and then the precipitate was removed from the centrifuged plating solution and only the supernatant liquid was separated therefrom and then prepared.

PREPARATION EXAMPLE 4

Preparation of Pretreated Plating Solution, from which Copper Ions and Sulfate Ions are Removed, using Sodium Hydroxide (NaOH) and Barium Chloride ($BaCl_2$)

10 mL of the electrolytic copper sulfate plating solution sample prepared in Preparation Example 1 was put into a 100 mL beaker and then stirred. 10 mL of a 1 M sodium hydroxide (NaOH) solution and 20 mL of a 0.1 M barium chloride ($BaCl_2$) solution were slowly dropped onto the stirred plating solution to form a precipitate. When the precipitate was formed, the dropping of the barium chloride solution was stopped, the plating solution was centrifuged, and then the precipitate was removed from the centrifuged plating solution and only the supernatant liquid was separated therefrom and then prepared.

PREPARATION EXAMPLE 5

Reagent Composition for MALDI-TOF Mass Spectroscopy

Polyethylene glycol (PEG) having a molecular weight of 4000 Da was used as a high-molecular additive, trihydroxy acetophenone (THAP) was used as a polar matrix, sodium trifluoroacetate (NaTFA) was used as a cationization agent, and methanol (MeOH) was used as a solvent.

PREPARATION EXAMPLE 6

Preparation of a Sample for Mass Analysis using Dried Droplet Method 2.5 mg of trihydroxy acetophenone (THAP), which is a polar matrix, was dissolved in 100 μl of methanol to form a matrix solution. Subsequently, 2 mg of sodium trifluoroacetate (NaTFA), which is a cationization agent, was dissolved in 100 μl of methanol to form a cationization agent solution. MTP 384 target ground steel TF was used as a target plate. A dried droplet method was used as a drying method. In the dried droplet method, 100 μl of the prepared plating solution was mixed with 100 μl of the matrix solution and 3 μl of the cationization agent solution to prepare a mixed solution, and then 0.5 μl of the mixed solution was spotted on the target plated and thus dried.

PREPARATION EXAMPLE 7

Preparation of a Sample for Mass Analysis using Double Layer Method 2.5 mg of trihydroxy acetophenone (THAP), which is a polar matrix, was dissolved in 100 μl of methanol to form a matrix solution. Subsequently, 2 mg of sodium trifluoroacetate (NaTFA), which is a cationization agent, was dissolved in 100 μl of methanol to form a cationization agent solution. MTP 384 target ground steel TF was used as a target plate. A double layer method was used as a drying method. In the double layer method, 0.5 μl of the matrix solution was spotted on the target plate and thus dried, and then 10 μl of the prepared plating solution was mixed with 3 μl of the cationization agent solution to prepare a mixed solution, and then 0.5 μl of the mixed solution was spotted on the dried matrix solution and thus dried.

PREPARATION EXAMPLE 8

Preparation of a Sample for Mass Analysis using Sandwich Method 2.5 mg of trihydroxy acetophenone (THAP), which is a polar matrix, was dissolved in 100 μl of methanol to form a matrix solution. Subsequently, 2 mg of sodium trifluoroacetate (NaTFA), which is a cationization agent, was dissolved in 100 μl of methanol to form a cationization agent solution. MTP 384 target ground steel TF was used as a target plate. A sandwich method was used as a drying method. In the sandwich method, 0.5 μl of the matrix solution was spotted on the target plate and thus dried, and then 10 μl of the prepared plating solution was mixed with 3 μl of the cationization agent solution to prepare a mixed solution, and then 0.5 μl of the mixed solution was spotted on the dried matrix solution and thus dried, and then the matrix solution was further spotted on the dried mixed solution and thus dried.

※ MALDI-TOF MS Equipment and Measured Variables※

A Bruker Autoflex II mass spectrometer was used to conduct mass analysis. An acceleration voltage of +19 kV was used to desorb ions. A microchannel plate (MCP) was used as detection equipment. Specifically, optimum equipment operation conditions for analyzing a plating solution were set as follows: the first ion source voltage was 19 kV, the second ion source voltage was 16.85 kV, the lens voltage was 8.50 kV, the reflector voltage was 20.00 kV, the pulsed ion extraction time was 160 ns, the detector gain was 7.1, and the positive reflection mode was applied.

COMPARATIVE EXAMPLE 1

A sample for mass analysis was prepared using the electrolytic copper sulfate plating solution prepared in Preparation Example 1 as a plating solution and using the dried droplet method as in Preparation Example 6. The sample was analyzed using a Bruker Autoflex II mass spectrometer under the above mentioned conditions.

Figure 2:
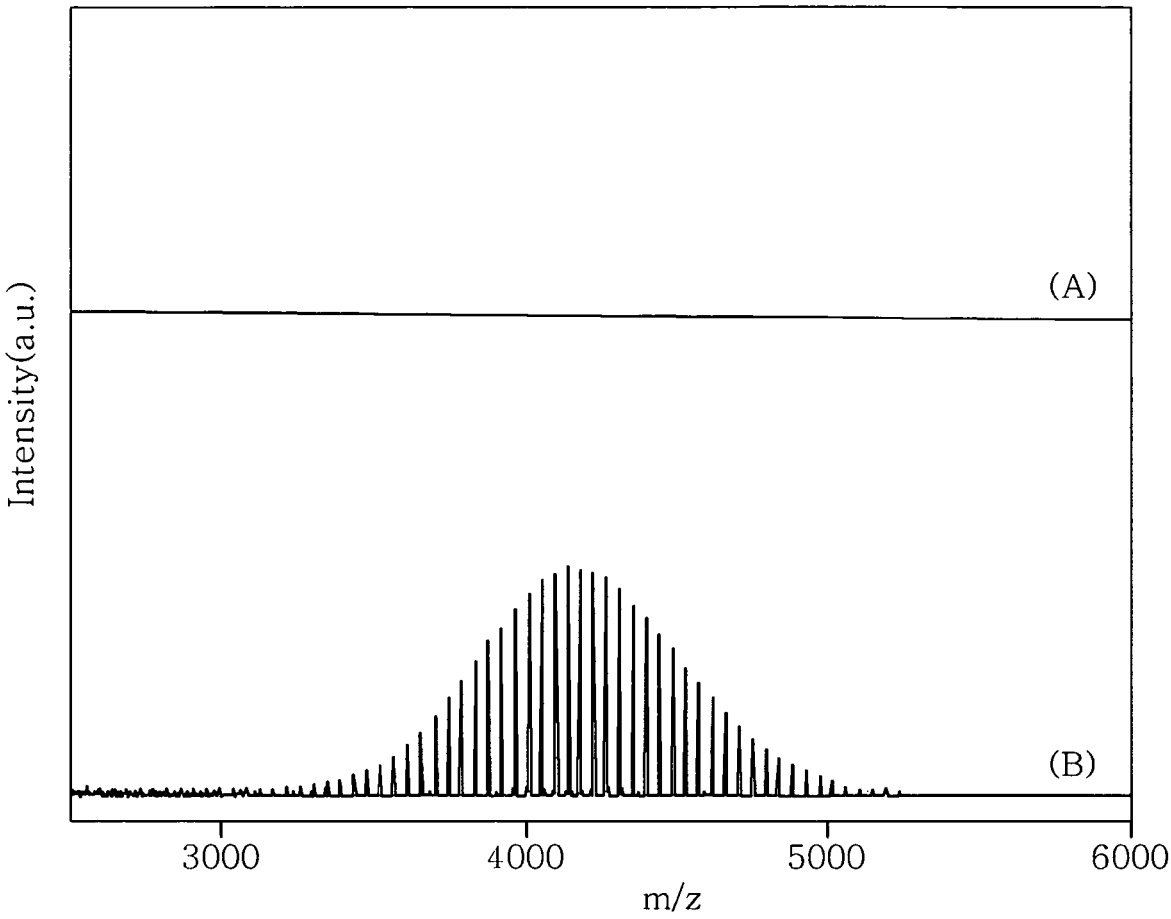
FIG. 2 is a graph showing mass spectra showing the results of the MALDI-TOF MS of a very small amount of high-molecular additives in an electrolytic copper sulfate plating solution before or after the pretreatment of plating solution samples according to Comparative Example 1 and Example 1 of the present invention.

The mass spectrum of the sample, obtained in this way, is shown as (A) in FIG. 2. From the mass spectrum, it can be seen that, when the mass analysis of the electrolytic copper sulfate plating solution is conducted without performing the pretreatment for removing interfering materials, as in conventional mass analysis methods, the mass spectrum in a high molecular weight region cannot be found.

EXAMPLE 1

A sample for mass analysis was prepared using the electrolytic copper sulfate plating solution prepared in Preparation Example 2 as a plating solution and using the dried droplet method as in Preparation Example 6. The sample was analyzed using the Bruker Autoflex II mass spectrometer under the above mentioned conditions.

The mass spectrum of the sample, obtained in this way, is shown as (B) in FIG. 2. From the mass spectrum, it can be seen that the mass spectrum in the high molecular weight region can be found.

Figure 3:
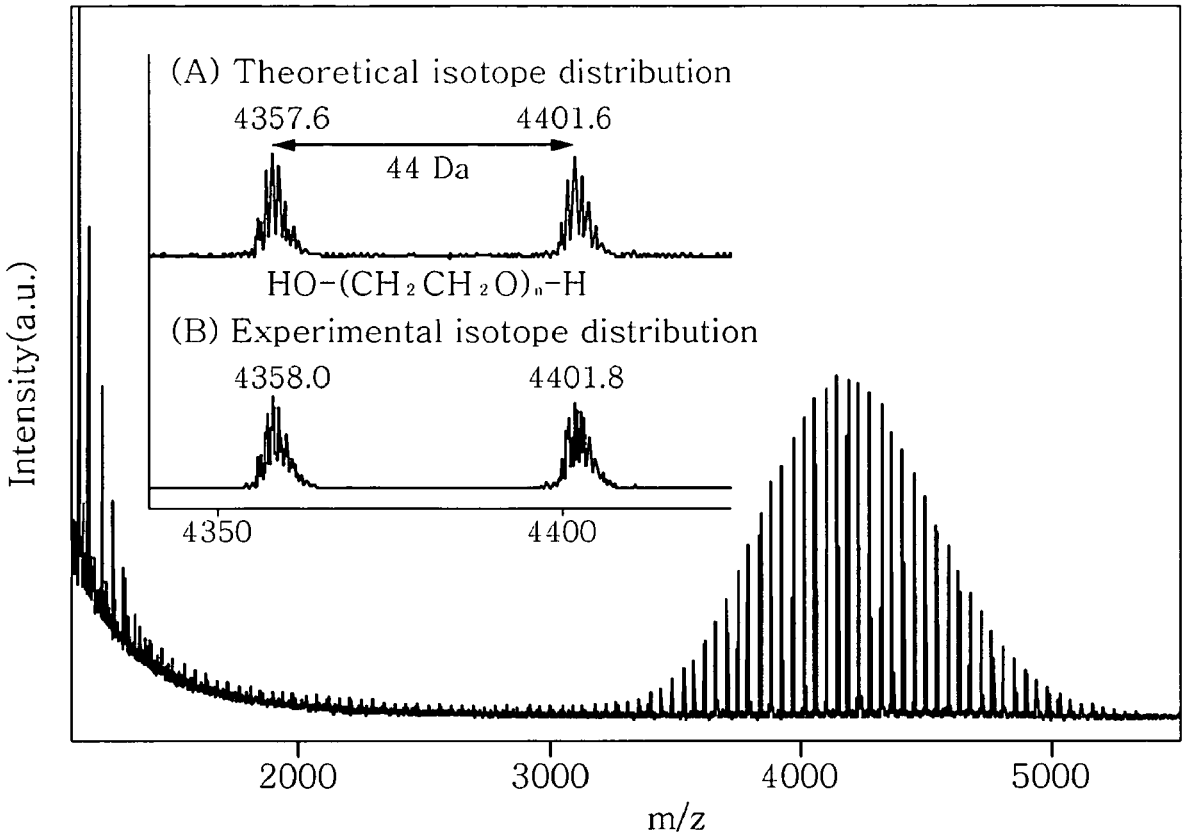
FIG. 3 is a graph comparing the experimental isotope distribution with theoretical isotope distribution in the mass spectra of a very small amount of high-molecular additives in an electrolytic copper sulfate plating solution obtained in Example 1 of the present invention.

Further, FIG. 3 shows mass spectra comparing the experimental isotope distribution with theoretical isotope distribution in the mass spectra of high-molecular additives present in very small amounts in an electrolytic copper sulfate plating solution experimentally obtained through the principle of the present invention.

As shown in FIG. 3, it can be seen that the mass spectrum of the electrolytic copper sulfate plating solution experimentally obtained through the principle of the present invention is the same as the mass spectrum of polyethylene glycol having a molecular weight of 4000 Da obtained using deionized water as a solvent. Specifically, as the results of comparing the experimental isotope distribution with theoretical isotope distribution in the mass spectra of high-molecular additives present in very small amounts in an electrolytic copper sulfate plating solution experimentally obtained through the principle of the present invention, it can be seen that since the difference between theoretical peak values and experimental peak values is within a maximum range of 0.4 Da, the structural analysis thereof was accurately conducted.

EXPERIMENTAL EXAMPLE 1

In order to observe the tendency of the degradation of a high-molecular additive, serving as a carrier, in the entire molecular weight region according to the plating time, the electrolytic copper sulfate plating solution prepared in Preparation Example 1 was plated on a printed circuit board at a current density of 13 $mA/cm^2$. The plating solution was sampled 30 minutes, 1 hour, 3 hours and 4 hours after plating and was then pretreated as in Preparation Example 3, and then a sample for mass analysis was prepared using a double layer method as in Preparation Example 7. The sample was analyzed using the Bruker Autoflex II mass spectrometer under the above mentioned conditions.

In this case, before the plating was conducted, the plating solution was previously sampled and then pretreated using the same method as above, and then mass analysis was conducted.

Figure 4:
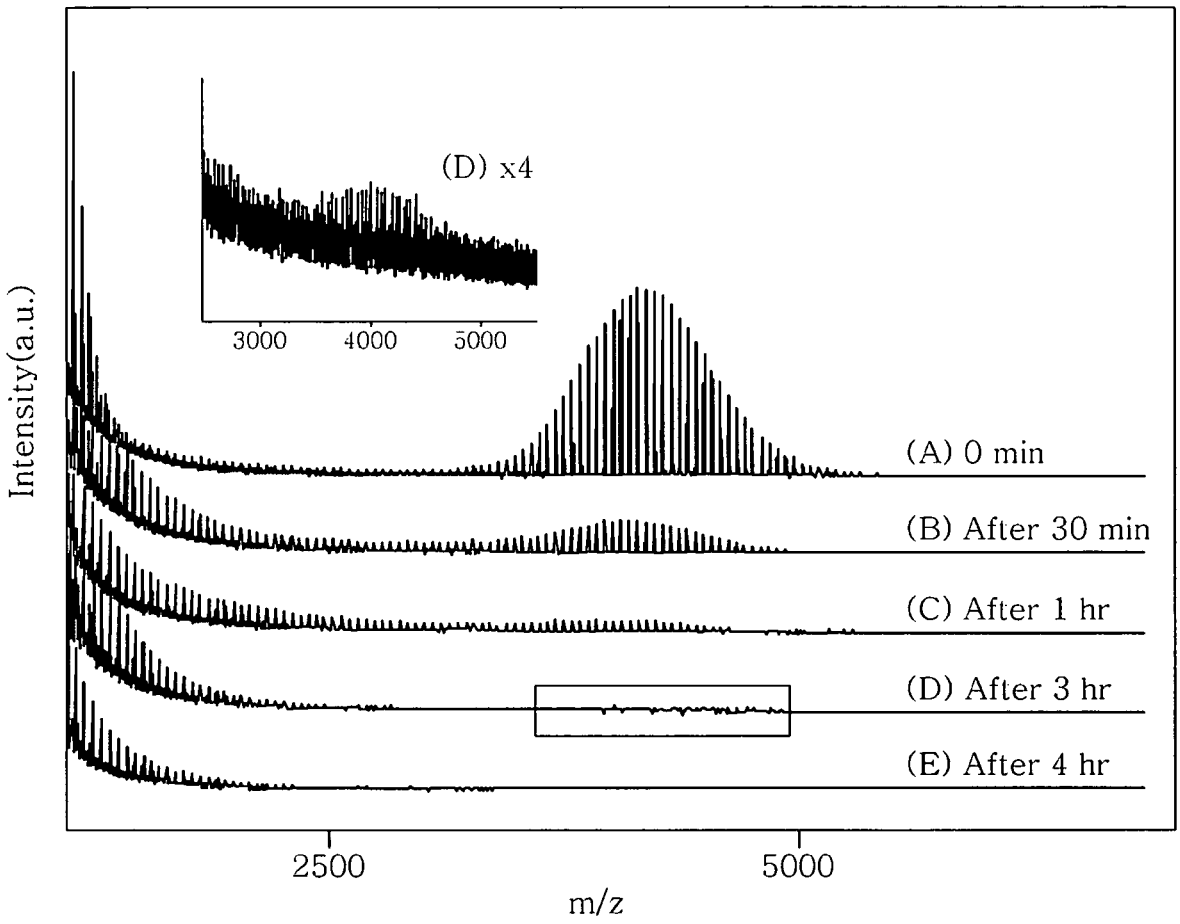
FIG. 4 is a graph showing mass spectra showing the effect of the degradation of high-molecular additives with respect to plating time at the time of plating electrolytic copper sulfate under a predetermined current density of 13 mA/cm$^2$ according to Experimental Example 1 of the present invention.

The mass spectra of the sample, obtained in this way, are shown in FIG. 4. Here, the mass spectrum of a very small amount of a high-molecular additive, before electrolytic plating, is shown as (A) in FIG. 4, the mass spectrum of a very small amount of a high-molecular additive, analyzed 30 minutes after electrolytic plating, is shown as (B) in FIG. 4, the mass spectrum of a very small amount of a high-molecular additive, analyzed 1 hour after electrolytic plating, is shown as (C) in FIG. 4, the mass spectrum of a very small amount of a high-molecular additive, analyzed 3 hours after electrolytic plating, is shown as (D) in FIG. 4, and the mass spectrum of a very small amount of a high-molecular additive, analyzed 4 hours after electrolytic plating, is shown as (E) in FIG. 4. Further, (D×4), inserted in FIG. 4, shows the mass spectrum in a molecular weight range of 2500 ~5500 Da of a high-molecular additive remaining in the plating solution without being degraded, analyzed 3 hours after electrolytic plating. From these mass spectra, it can be seen that the high-molecular additive is rapidly degraded depending on the increase in plating time. In particular, 4 hours after electrolytic plating, a high-molecular additive having a molecular weight of 4000 Da was completely degraded, and thus peaks are shown only in a molecular weight region of 2000 Da or less.

EXPERIMENTAL EXAMPLE 2

In order to observe the tendency of the degradation of a high-molecular additive, serving as a carrier, in a low molecular weight region according to the plating time, the electrolytic copper sulfate plating solution prepared in Preparation Example 1 was plated on a printed circuit board at a current density of 13 mA/cm$^2$. The plating solution was sampled 30 minutes and 3 hours after plating and was then pretreated as in Preparation Example 4, and then a sample for mass analysis was prepared using a sandwich method as in Preparation Example 8. The sample was analyzed using the Bruker Autoflex II mass spectrometer under the above mentioned conditions.

In this case, before the plating was conducted, the plating solution was previously sampled and then pretreated using the same method as above, and then mass analysis was conducted. Here, mass analysis was conducted in a low molecular weight region of 880~1030 Da, and the changes in peaks in the low molecular weight region due to the degradation of a high molecular additive were observed.

Figure 5:
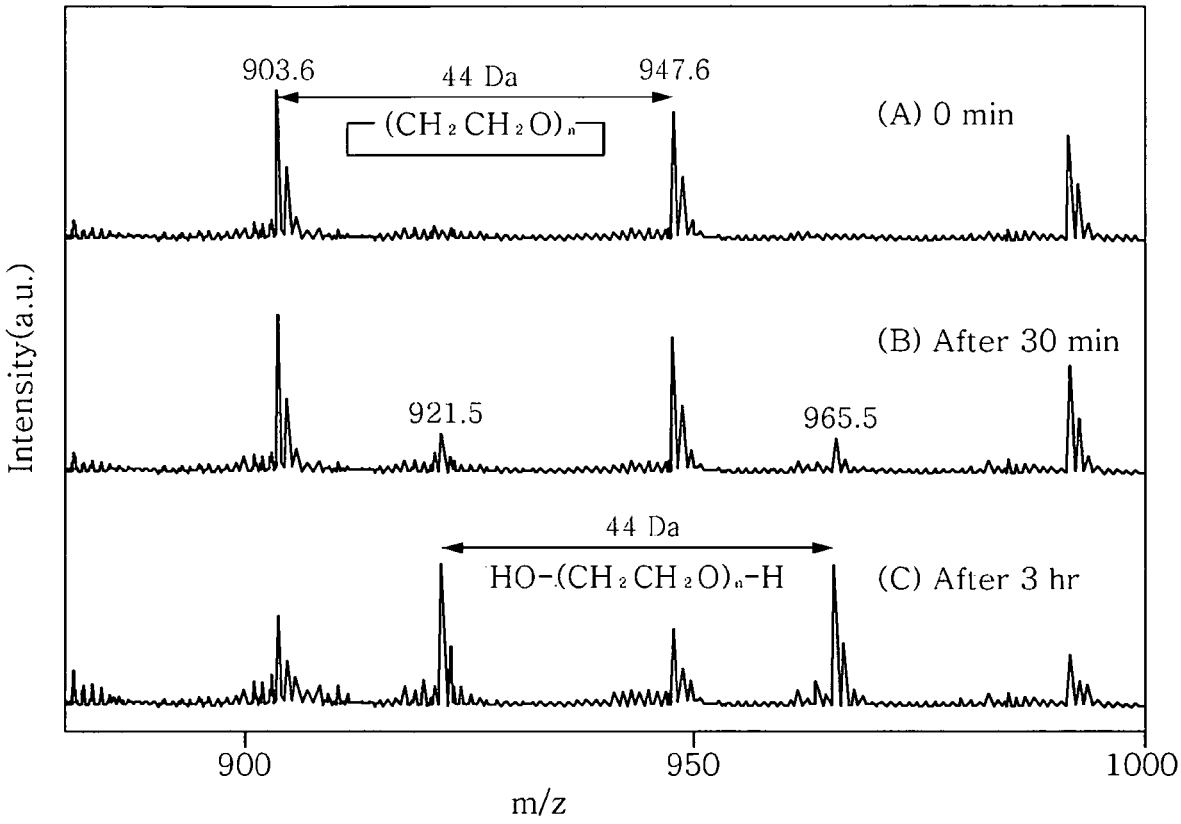
FIG. 5 is a graph showing mass spectra showing the change in the peaks of high-molecular additives in a low molecular weight region of 880~1030 Da with respect to plating time at the time of plating electrolytic copper sulfate under a predetermined current density of 13 mA/cm$^2$ according to Experimental Example 2 of the present invention.

The mass spectra of the sample, obtained in this way, are shown in FIG. 5. Here, (A) of FIG. 5 is a mass spectrum showing the peaks of polyethylene glycol (PEG) present in a low molecular weight region before electrolytic plating. Before electrolytic plating is conducted, only annular PEG is present. (B) of FIG. 5 is a mass spectrum showing the peaks of polyethylene glycol (PEG) present in a low molecular weight region 30 minutes after electrolytic plating. In (B), linear PEG as well as annular PEG starts to appear. (C) of FIG. 5 is a mass spectrum showing the peaks of polyethylene glycol (PEG) present in a low molecular weight region 3 hours after electrolytic plating. In (C), linear PEG is more clearly apparent. In conclusion, it can be seen that the peaks of the linear PEG, which was not present in a high-molecular additive before plating, appear 30 minutes after the plating, and that the peaks of the linear PEG are greater than those of the annular PEG, which was present in the high-molecular additive before plating.

EXPERIMENTAL EXAMPLE 3

In order to observe the tendency of the degradation of a high-molecular additive, serving as a carrier according to current density applied to the high-molecular additive at the time of electrolytic copper sulfate plating, the electrolytic copper sulfate plating solution prepared in Preparation Example 1 was plated on a printed circuit board at a current density of 1.3, 13, and 25 mA/cm$^2$ for a predetermined time (30 minutes). Then, the plating solution was sampled and then pretreated as in Preparation Example 2, and then a sample for mass analysis was prepared using a dried droplet method, as in Preparation Example 6. The sample was analyzed using the Bruker Autoflex II mass spectrometer under the above-mentioned conditions.

In this case, before the plating was conducted, the plating solution was previously sampled and then pretreated using the same method as above, and then mass analysis was conducted.

Figure 6:
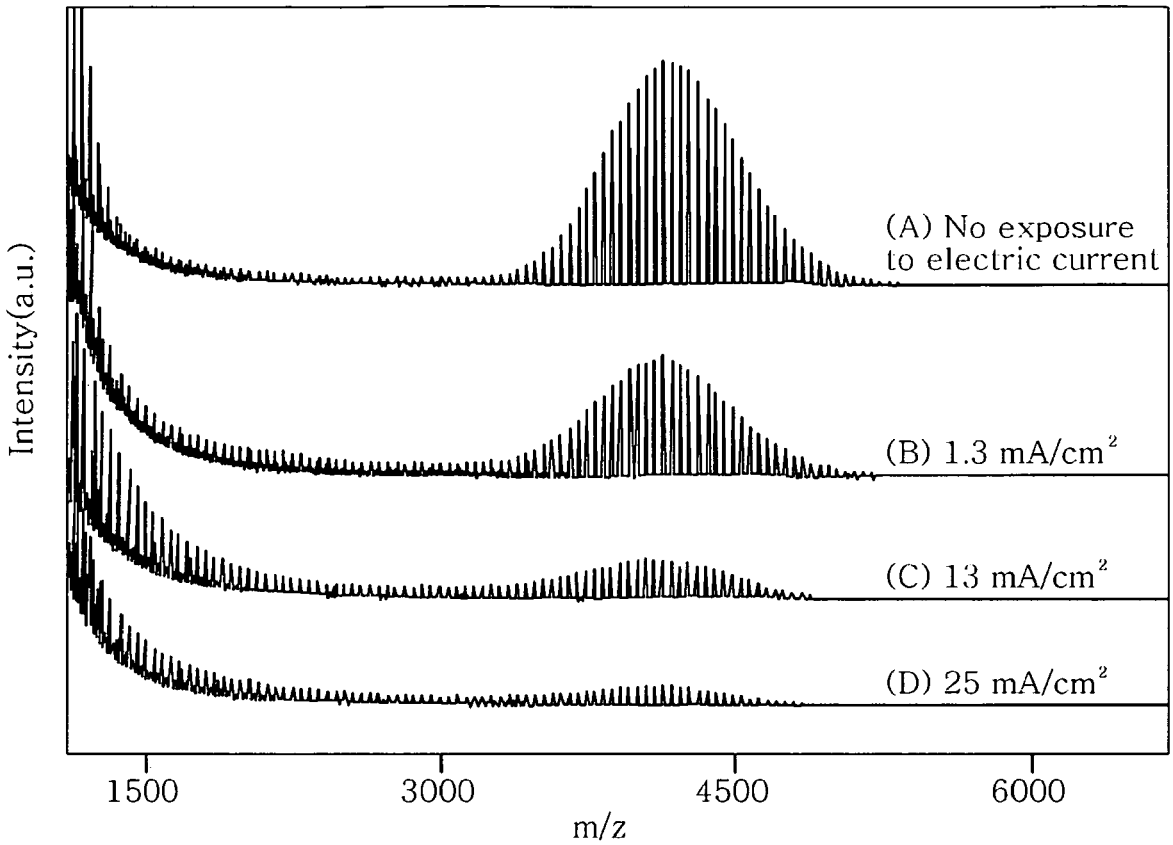
FIG. 6 is a graph showing mass spectra showing the effect of the degradation of high-molecular additives with respect to current density at the time of electrolytic plating for a predetermined time (30 minutes) according to Experimental Example 3 of the present invention.

The mass spectra of the sample, obtained in this way, are shown in FIG. 6. Here, (A) of FIG. 6 shows a mass spectrum of a very small amount of a high-molecular additive before electrolytic plating. (B) of FIG. 6 shows a mass spectrum of a very small amount of a high-molecular additive at a current density of 1.3 mA/cm$^2$ after electrolytic plating. (C) of FIG. 6 shows a mass spectrum of a very small amount of a high-molecular additive at a current density of 13 mA/cm$^2$ after electrolytic plating. (D) of FIG. 6 shows a mass spectrum of a very small amount of a high-molecular additive at a current density of 25 mA/cm$^2$ after electrolytic plating. From FIG. 6, it can be seen that the degree of the degradation of a high-molecular additive, serving as a carrier, is increased as current density in electrolytic plating is increased.

EXPERIMENTAL EXAMPLE 4

A test for observing the tendency of a high-molecular additive, serving as a carrier, to be degraded with the passage of time when the electrolytic copper sulfate plating solution prepared in Preparation Example 1 was left at room temperature was conducted. In order to observe the effect of the degradation of the high-molecular additive in the plating solution with the passage of time, the plating solution was pretreated as in Preparation Example 2, and then a sample for mass analysis was prepared using a dried droplet method, as in Preparation Example 6. The sample was analyzed using the Bruker Autoflex II mass spectrometer under the above mentioned conditions.

Figure 7:
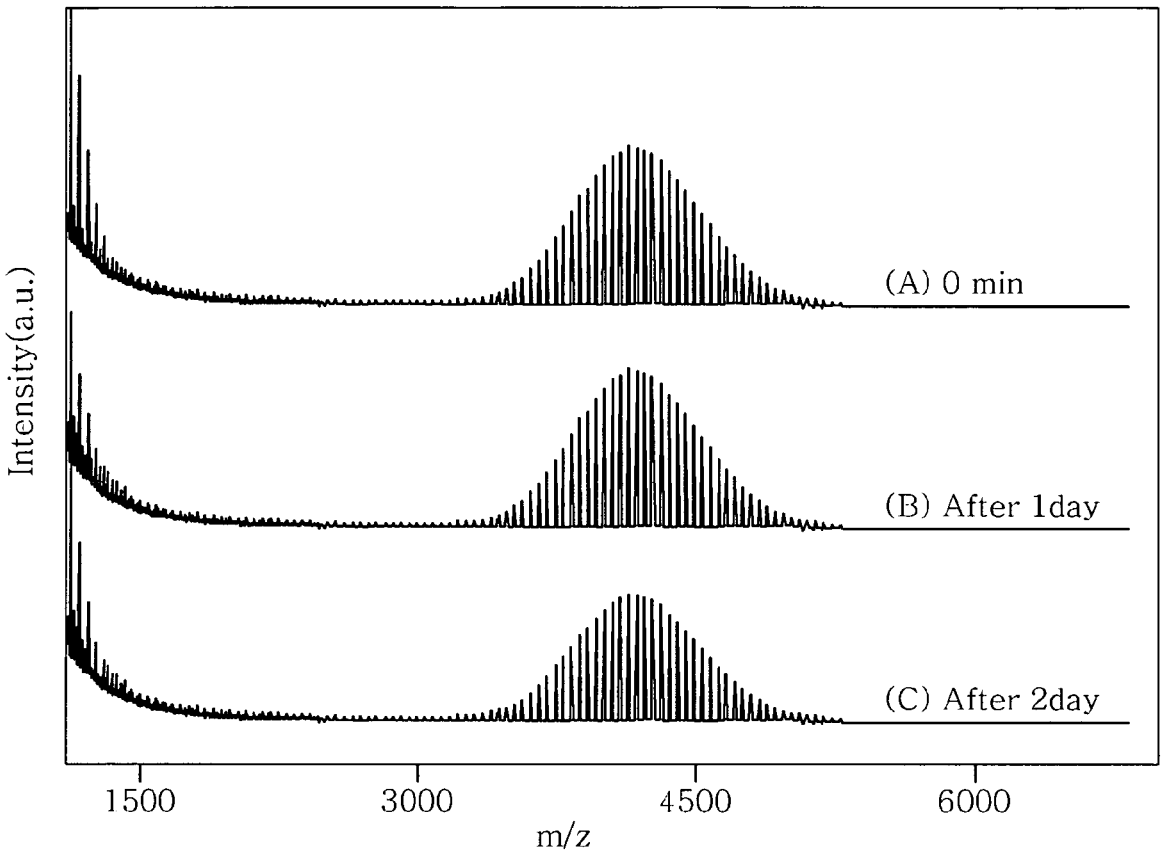
FIG. 7 is a graph showing mass spectra showing the effect of the degradation of high-molecular additives in an electrolytic copper sulfate solution having a pH of 1 or less with the passage of time according to Experimental Example 4 of the present invention.

Mass spectra of the sample, obtained in this way, are shown in FIG. 7. Here, (A) of FIG. 7 shows the mass spectrum of a very small amount of a high-molecular additive, analyzed immediately after the preparation of the plating solution, (B) of FIG. 7 shows the mass spectrum of a very small amount of a high-molecular additive, analyzed 1 day after the preparation of the plating solution, and (C) of FIG. 7 shows the mass spectrum of a very small amount of a high-molecular additive, analyzed 2 days after the preparation of the plating solution. From FIG. 7, it can be seen that the high-molecular additive was not almost degraded even after 2 days had passed, and it can be also seen that the high-molecular additive in the electrolytic copper sulfate plating solution underwent continuous slight degradation.

As described above, according to the present invention, in order to analyze the structure and molecular weight of high-molecular additives present in very small amounts in a metal plating solution, which cannot be accurately qualitatively analyzed using conventional technologies, excess sulfate ions and metal ions are removed from the metal plating solution, and the pretreatment conditions of a sample are optimized, thus enabling the qualitative analysis of the high-molecular additives. Further, unlike conventional electrical extraction methods, high-molecular additives in a plating solution are not degraded, and the specific molecular weight thereof is maintained, thus enabling accurate mass analysis. Comparing the peak values in the spectrum obtained using this method with theoretical values, since only a maximum error of about 0.4 Da is shown in the spectrum, it can be seen that this method is very accurate. Further, since the characteristics of the high-molecular additives used in plating are determined by the molecular weight and chemical structure thereof, the degradation and structural changes thereof can be monitored at the time of plating, and thus the quality of products can be improved such that the products have excellent plating properties without defects such as voids. Furthermore, the present invention can play an important role in the examination of unknown high-molecular additives and the development of a plating solution at the time of benchmarking the advanced companies.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of qualitatively analyzing high-molecular additives in a metal plating solution, comprising:

removing sulfate ions and metal ions from a metal plating solution; and qualitatively analyzing the metal plating solution, from which sulfate ions and metal ions are removed, using Matrix-Assisted Laser Desorption/Ionization Time-Of-Flight Mass Spectroscopy (MALDI-TOF MS).

2. The method of qualitatively analyzing high-molecular additives in a metal plating solution according to claim 1, wherein the removing the sulfate ions and metal ions is conducted using a chemical precipitation method.

3. The method of qualitatively analyzing high-molecular additives in a metal plating solution according to claim 2, wherein the chemical precipitation method is conducted using a precipitant selected from the group consisting of alkali metals or alkali metal hydroxides, nitrates, halogenides, and mixtures thereof.

4. The method of qualitatively analyzing high-molecular additives in a metal plating solution according to claim 2, wherein the chemical precipitation method is conducted using a precipitant selected from the group consisting of NaOH, KOH, $BaCl_2$, $Ba(NO_3)_2$, $Ba(OH)_2$, and mixtures thereof.

5. The method of qualitatively analyzing high-molecular additives in a metal plating solution according to claim 3, wherein a volume ratio of the precipitant to the metal plating solution is 0.5:1~2.5:1.

6. The method of qualitatively analyzing high-molecular additives in a metal plating solution according to claim 1, wherein the qualitatively analyzing the metal plating solution using MALDI-TOF MS comprises:

mixing the metal plating solution, from which sulfate ions and metal ions are removed, with a matrix and a cationization agent to form a crystal; and lasing the crystal and then analyzing the lased crystal using Time-Of-Flight Mass Spectroscopy (TOF-MS).

7. The method of qualitatively analyzing high-molecular additives in a metal plating solution according to claim 6, wherein the matrix is selected from the group consisting of dihydroxybenzoic acid (DHB), sinapinic acid, trihydroxy acetophenone (THAP), hydroxyphenylazo benzoic acid (HABA), dithranol, cyano-hydroxycinnamic acid (CHCA), all- trans-retinoic acid (RA), indoleacrylic acid (IAA), and mixtures thereof.

8. The method of qualitatively analyzing high-molecular additives in a metal plating solution according to claim 6, wherein the cationization agent is selected from the group consisting of alkali metal acetates, transition metal acetates, and mixtures thereof.

9. The method of qualitatively analyzing high-molecular additives in a metal plating solution according to claim 6, wherein the matrix is trihydroxy acetophenone and the cationization agent is sodium trifluoroacetate.

10. The method of qualitatively analyzing high-molecular additives in a metal plating solution according to claim 6, wherein a volume ratio of the metal plating solution, matrix and cationization agent is 50:100:1~150:200:1.

11. The method of qualitatively analyzing high-molecular additives in a metal plating solution according to claim 6, wherein the forming the crystal is conducted by drying the metal plating solution, matrix and cationization agent on a target plate using a dried droplet method.

12. The method of qualitatively analyzing high-molecular additives in a metal plating solution according to claim 6, wherein the forming the crystal is conducted by drying the metal plating solution, matrix and cationization agent on a target plate using a double layer method.

13. The method of qualitatively analyzing high-molecular additives in a metal plating solution according to claim 6, wherein the forming the crystal is conducted by drying the metal plating solution, matrix and cationization agent on a target plate using a sandwich method.

14. An apparatus for qualitatively analyzing high-molecular additives in a metal plating solution, comprising:

means for removing sulfate ions and metal ions from a metal plating solution; and means for qualitatively analyzing the metal plating solution, from which sulfate ions and metal ions are removed, using Matrix-Assisted Laser Desorption/Ionization Time-Of-Flight Mass Spectroscopy (MALDI-TOF MS).

15. The method of qualitatively analyzing high-molecular additives in a metal plating solution according to claim 4, wherein a volume ratio of the precipitant to the metal plating solution is 0.5:1~2.5:1.

* * * * *